US005875535A

United States Patent [19]

Canoy

[11] Patent Number: 5,875,535

[45] Date of Patent: Mar. 2, 1999

[54] HINGE PIN REMOVAL TOOL

[76] Inventor: James J. Canoy, 2226 Cent. Ave. West. #16, Great Falls, Mont. 59404

[21] Appl. No.: 19,899

[22] Filed: Feb. 9, 1998

[51] Int. Cl.[6] ..... B25B 27/14

[52] U.S. Cl. ..... 29/275; 29/278

[58] Field of Search ..... 29/275, 270, 278, 29/254; 254/25; 83/687; 30/358, 366

[56] References Cited

U.S. PATENT DOCUMENTS

| | | | |
|---|---|---|---|
| 4,188,701 | 2/1980 | Ludwig | 29/275 |
| 4,454,792 | 6/1984 | Burris | 29/254 |
| 5,099,562 | 3/1992 | Loughran . | |
| 5,435,030 | 7/1995 | Phillips . | |
| 5,438,743 | 8/1995 | Simington et al. | 29/275 |
| 5,617,757 | 4/1997 | Horner | 29/270 |
| 5,695,172 | 12/1997 | Hreha | 254/27 |

*Primary Examiner*—David A. Scherbel
*Assistant Examiner*—Lee Wilson

[57] ABSTRACT

A hinge pin removal tool for removing a head capped pin from a knuckled door hinge. The hinge pin removal tool comprises an elongate shaft, a generally planar tool head attached to the elongated shaft which extends therefrom. The tool head includes a first and a second end. The tool head is attached to the elongate shaft proximate to the second end of the tool head. The tool head further includes a tapered chisel edge disposed at the tool head first end, and an elongate pin punch disposed orthogonally to the tool head intermediate the chisel edge of the first end and the second end. The tool head may be disposed orthogonally to the elongate shaft. In a second embodiment the tool head and elongate shaft are substantially collinear. The hinge pin removal tool may further include an open slot disposed in the chisel edge which extends inwardly therefrom toward the second end of the tool head. The slot width is sized to accommodate a hinge pin shaft. The hinge pin removal tool shaft may include a first and a second end, wherein the first and second end each include a tool head attached thereto. In this version of the hinge pin removal tool, the two tool heads are disposed at opposite directions relative to each other. Each tool head includes a chisel edge and an elongate pin punch.

9 Claims, 5 Drawing Sheets

HINGE PIN REMOVAL TOOL

BACKGROUND

Removing a hinge pin from a door hinge is typically required if the door is to be removed from the door frame in which it is mounted. The process of removing the hinge pin may be difficult as some door hinges have been manufactured with close manufacturing tolerances to provide a smooth opening door without any play in the hinges. In other cases, hinge pin removal may be difficult due to poor manufacturing practices which results in the hinge pin fitting tighter than was desired due to poor fitting or misaligned hinge sections. Still other hinges have hinge pins that are intentionally difficult to remove to aid in door security. These hinges use pins that have to be driven into the hinge knuckles due to an interference fit that has been designed into the hinge assembly. The hinge pin may also include a knurled section close to the pin head that increases the outside diameter of the pin and causes the pin to bite into the hinge knuckle as it is driven into the hinge knuckle. Still other hinges use a closed bottom knuckle or a pressed-in cap in the bottom knuckle of the hinge. In hinge assemblies such as this, a punch is prevented from being able to drive out the pin by striking on the bottom of the pin.

Although hinge pin removal is made difficult for the reasons previously mentioned, there are few tools available to assist in hinge pin removal. The person attempting hinge pin removal typically uses one of two different methods to remove the hinge pin. If the hinge bottom knuckle is not capped and remains open, a long shafted tool such as a punch or a nail can be inserted into the knuckle to drive the pin upwardly by striking on the bottom of the pin through the punch or the nail. If the hinge knuckle is capped or if a suitable long shafted tool is not available for driving out the hinge pin, the person attempting the hinge pin removal must try to drive the pin upwardly by pounding a flat tool such as a screwdriver head between the underside of the hinge pin head and the adjacent hinge knuckle.

Both common hinge pin removal processes are problematic and may result in damage to the hinge, as well as to the door or door frame molding.

The process of removing a pin by forcing the pin upwardly through the use of a punch or a nail can be damaging to the door or the molding. A nail or punch inserted into the bottom hinge knuckle will, of course, extend straight down from the hinge knuckle. The hinge knuckles are typically immediately adjacent to the door outer surface and the door frame molding. The hinge knuckles also typically extend into the interior of the room only a small amount. Because of this, the punch or nail inserted into the knuckle will, by necessity, remain dangerously close to the door outer surface and the door frame molding. The act of striking the nail or punch with a hammer is awkward due to the necessity to swing the hammer upwardly. Damage to the door and door frame molding is common because of the hammer often striking the door or frame molding in place of the nail or punch. Finger injuries are also common from this procedure.

In the second common hinge pin removal procedure, the person attempting the hinge pin removal must try to drive the pin upwardly by pounding a flat tool such as the bladed head of a screwdriver between the underside of the hinge pin head and the adjacent hinge knuckle. The blade must be driven between the pin head and the hinge top knuckle. There is typically no gap between the pin head and the knuckle within which to initially insert the blade. Because of this, hammer strikes often cause the screw driver to deflect off the pin and into the door or door frame. Even if the worker keeps the bladed head of the screwdriver properly in place on the pin while driving the pin upward, there will be some metal deformation from the process which will disfigure the hinge pin head and the hinge top knuckle. There also may be some paint chipping if the hinges have been painted.

Because of the previously mentioned reasons, there is a need for a hinge pin removal tool that allows the user to drive the pin upwardly by striking the bottom of the pin without potentially causing damage to the door or door frame molding. There is a further need that the tool provide a hand hold position which places the hand in a protected position where it unlikely will be hit by a striking hammer. There is a further need for a hinge pin removal tool that can easily be urged between the pin head and the top hinge knuckle to lift the pin head from the position where the pin head is adjacent to the top hinge knuckle. There is a need for a hinge pin removal tool that performs this task without causing damage to the hinge and the hinge pin, as well as to the door and door frame. There is a further need for a hinge pin tool that can securely engage the shaft of a hinge pin immediately below the pin head during the removal process. There is still a further need for a hinge pin tool that accommodates different sized hinge pins so as to be an effective hinge pin removal tool for doors of all sizes and weights.

SUMMARY

The present invention comprises a hinge pin removal tool for removing a head capped pin from a knuckled door hinge. The hinge pin removal tool comprises an elongate shaft, a generally planar tool head attached to the elongated shaft which extends therefrom. The tool head includes a first and a second end. The tool head is attached to the elongate shaft proximate to the second end of the tool head. The tool head further includes a tapered chisel edge disposed at the tool head first end, and an elongate pin punch disposed orthogonally to the tool head intermediate the chisel edge of the first end and the second end.

The tool head may be disposed orthogonally to the elongate shaft. In a second embodiment the tool head and elongate shaft are substantially collinear. The hinge pin removal tool may further include an open slot disposed in the chisel edge which extends inwardly therefrom toward the second end of the tool head. The slot typically includes a distal end opposed to the chisel edge, wherein the distal end includes a semicircular wall. The slot width is sized to accommodate a hinge pin shaft.

The hinge pin removal tool shaft may include a first and a second end, wherein the first and second end each include a tool head attached thereto. In this version of the hinge pin removal tool, the two tool heads are disposed at opposite directions relative to each other. Each tool head includes a chisel edge and an elongate pin punch.

The hinge pin removal tool of the present invention provides benefits that have previously been unavailable.

A first benefit of the hinge pin tool of the present invention is a substantial decrease in damage accidently done to the door surface of the door frame molding through use of the tool. This benefit is accomplished by the tool head shape which includes an elongate pin punch for insertion into a hinge bottom knuckle where the pin punch contacts the bottom end of the hinge pin. The pin punch is disposed orthogonally on the tool head. The tool head typically is of a size as to allow a hammer to contact the tool head while keeping the hammer head a safe distance from the door or door frame molding. This increased striking surface is unavailable to those using a standard punch or nail to perform this task which often results in door and door frame molding damage from errant hammer strikes.

A second benefit of the hinge removal tool is added hand protection when driving hinge pins using the pin punch of the tool. The upward hammer swings necessary to pound a hinge pin upward are difficult to control and often cause injury to hands used to hold the punches or nails typically used in this removal procedure. The present invention provides an elongate shaft that is attached to the tool head which provides a hand grip portion well away from the striking surface on the bottom of the tool head. This elongate shaft can be attached to the tool head as to be aligned with the tool head or orthogonal to it.

A third benefit of the hinge pin removal tool of the present invention is the ability to easily urged between a pin head and the top hinge knuckle to thereby lift the pin. This feature is necessary in hinge pin removals where a pin punch cannot be inserted into the bottom knuckle of the hinge. The head of the pin removal tool includes a chisel edge that is much wider and sharper than the blade of a screwdriver which is usually used to accomplish this task. The chisel edge is able to lift the hinge pin to separate the pin head from the hinge top knuckle. The taper of the chisel edge prevents the chisel edge from deforming the hinge pin head or the adjacent hinge knuckle during this process. The extra edge width ensures that the chisel edge will not leave contact with the hinge pin head as it is urged by hammer strikes between the hinge pin head and the hinge top knuckle.

Another advantage of the hinge removal tool of the present invention is the ability to securely engage a hinge pin during the hinge pin removal process. The tool head includes an open slot which extends inwardly from the chisel edge and ends in a semicircular wall. The slot is effective in engaging a hinge pin so that the tool can be pounded upwardly against the hinge pin head without any likelihood that the tool will disengage the hinge pin. The secure engagement of the tool on the hinge pin also allows the user to force the pin upward and out of the hinge knuckles by pulling upwardly on the tool. The ability of the hinge pin removal tool to lift a hinge pin by hand pressure only is a further advantage of the hinge pin removal tool.

The hinge pin removal tool of the present invention offers the additional advantage of usability with hinges of all sizes. In one version of the tool, the hinge pin removal tool includes two tool heads with each tool head including a pin punch. In this version, the two pin punches are constructed at two different diameters. Accordingly, the tool includes a first pin punch that accommodates most residential interior doors and a second pin punch having a larger diameter for heavier door hinges which have a larger diameter hinge pin. This second size would also accommodate most commercial use doors as well as many industrial doors. These and other advantages of the present invention will become apparent upon inspection of the accompanying specification, claims, and drawings.

DRAWINGS

DESCRIPTION

Figure 1:
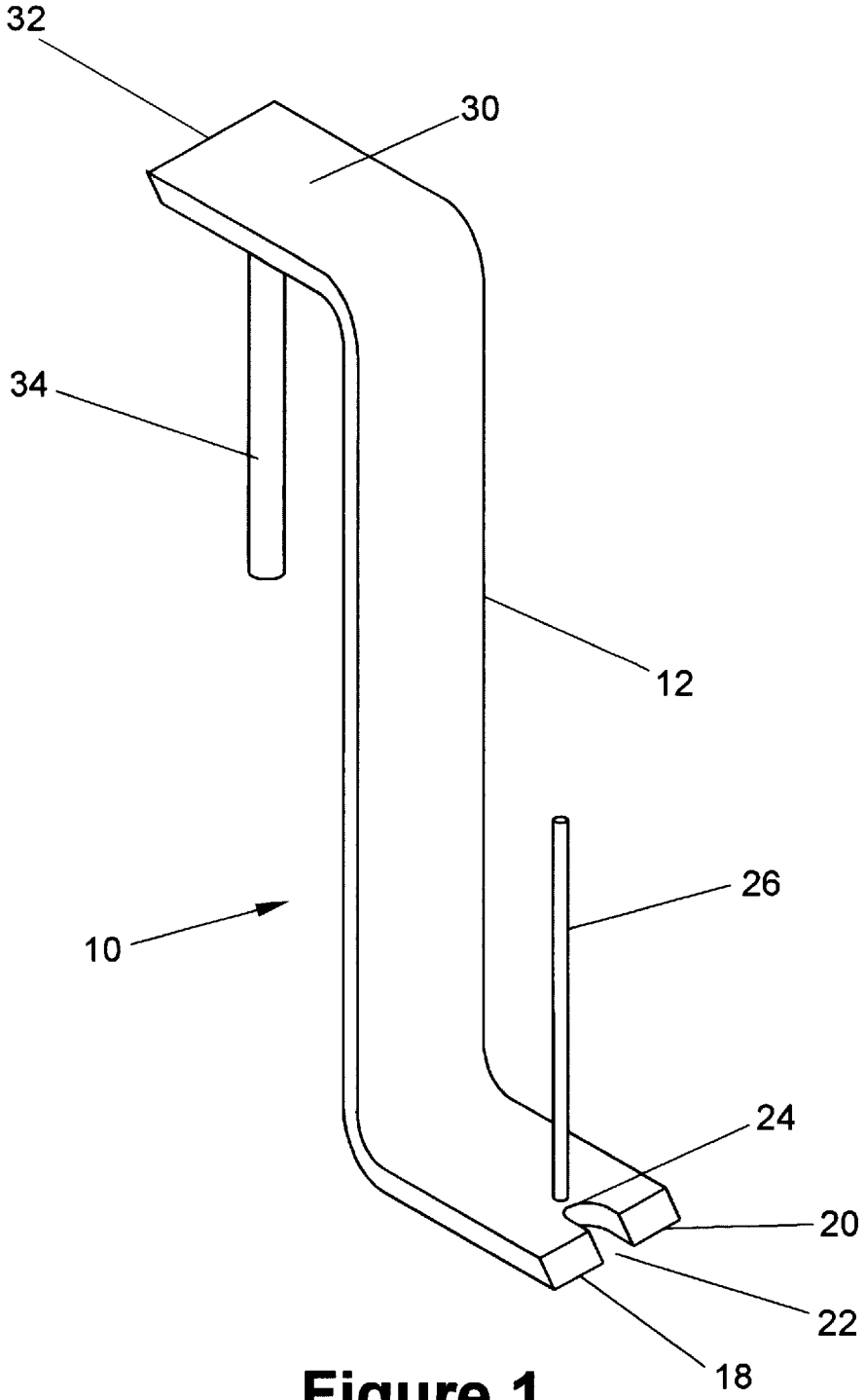
FIG. 1 is a perspective view showing the hinge pin removal tool of the present invention.

In greater detail, FIG. 1 shows a perspective view of a first version of the hinge pin removal tool 10 of the present invention. The hinge pin removal tool 10 includes an elongate shaft 12, a first tool head 14, and a second tool head 30. First tool head 14, and a second tool head 30 are disposed at opposite ends of the elongate shaft 12. First tool head 14 and second tool head 30 are both disposed orthogonally to the elongate shaft 12 and extend in opposite directions relative to each other. Tool head 14 includes a tapered chisel edge split into two sections 18 and 20 which are separated by a slot 22. Slot 22 includes a distal end opposite the chisel edges which has a semicircular wall 24. The tapered chisel edges 18 and 20 are disposed on a first end of the tool head 14 which is opposite a second end that is attached to the elongate shaft 12. The tool head 14 further includes a pin punch 26 disposed orthogonally to the tool head intermediate the chisel edge of the first end of the tool head and the second end of the tool head. As is shown in FIG. 1, the pin punch 26 is proximate to the semicircular wall 24 of slot 22.

FIG. 1 also shows the second tool head 30 which also includes a tapered chisel edge 32 and a pin punch 34. The tapered chisel edge 32 is not separated into two sections by a slot but instead is a continuous tapered edge. Pin punch 34, which is orthogonally disposed on the tool head 30, has a larger diameter than pin punch 26, and is designed for larger hinge pins that may be found in commercial and industrial doors as well as some house exterior doors. Pin punch 34 is disposed in an opposite direction to pin punch 26. The pin punch is disposed on the tool head 30 intermediate a first end defined by the tapered chisel edge 32 and a second end which is attached to the elongate shaft 12.

Although not shown in this figure, shaft 12 could be configured differently to provide a comfortable hand hold surface. Accordingly, the elongate shaft could be made to be widest at each end of the shaft where the shaft is attached to the tool heads. The width of the shaft would be tapered to a narrower hand hold area between the ends. It is understood that the elongate shaft could utilize many different configurations that would enhance the manipulation of the tool.

Figure 2:
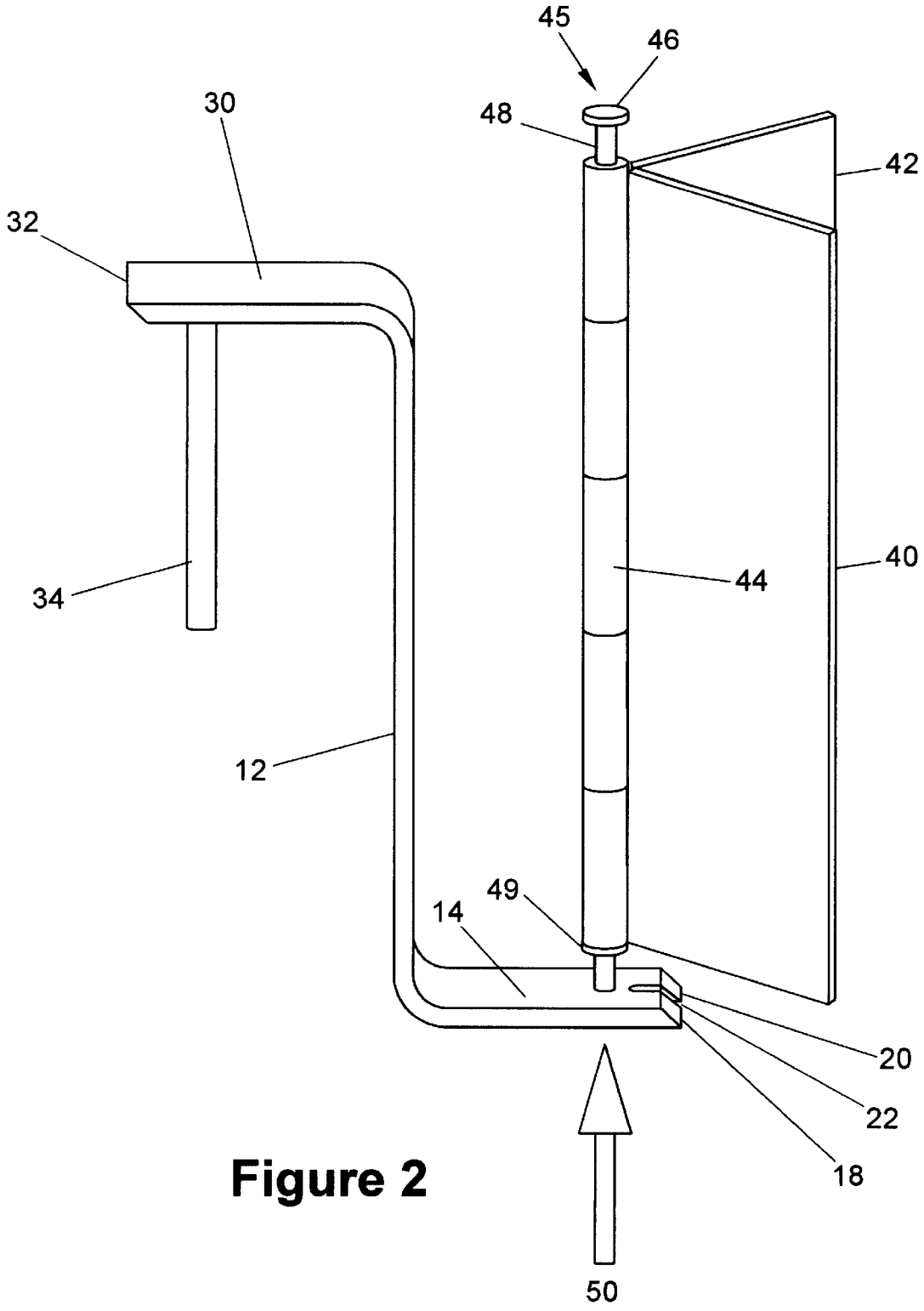
FIG. 2 is a side view showing the first version of the hinge pin removal tool extracting a hinge pin through the application of force on a pin punch disposed on the tool.

FIG. 2 shows a hinge assembly including hinge plates 40 and 42 which would be attached to a door and a door frame, respectively. Hinge plates 40 and 42 include hinge knuckles 44 which provide a cylindrical passage for a hinge pin 45. Hinge pin 45 includes a pin head 46 and a shaft 48. The hinge further includes a cap 49 disposed in the hinge bottom knuckle.

FIG. 2 further shows the pin punch 26 being used to drive the pin 45 upwardly in relation to hinge knuckles 44. The pin punch 26 is shown extending through a passage in cap 49 where it contacts the bottom of the hinge pin shaft 48. The tool is shown being contacted on the bottom of the tool head 14 at arrow 50. Striking or contacting the tool head 14 drives the pin punch 26 into the bottom of the hinge pin shaft which drives the hinge pin upward. Although the tool head 14 is shown being contacted immediately beneath the pin punch 26, the tool has sufficient rigidity and strength to be struck at any location on the bottom surface of tool head 14.

Figure 3:
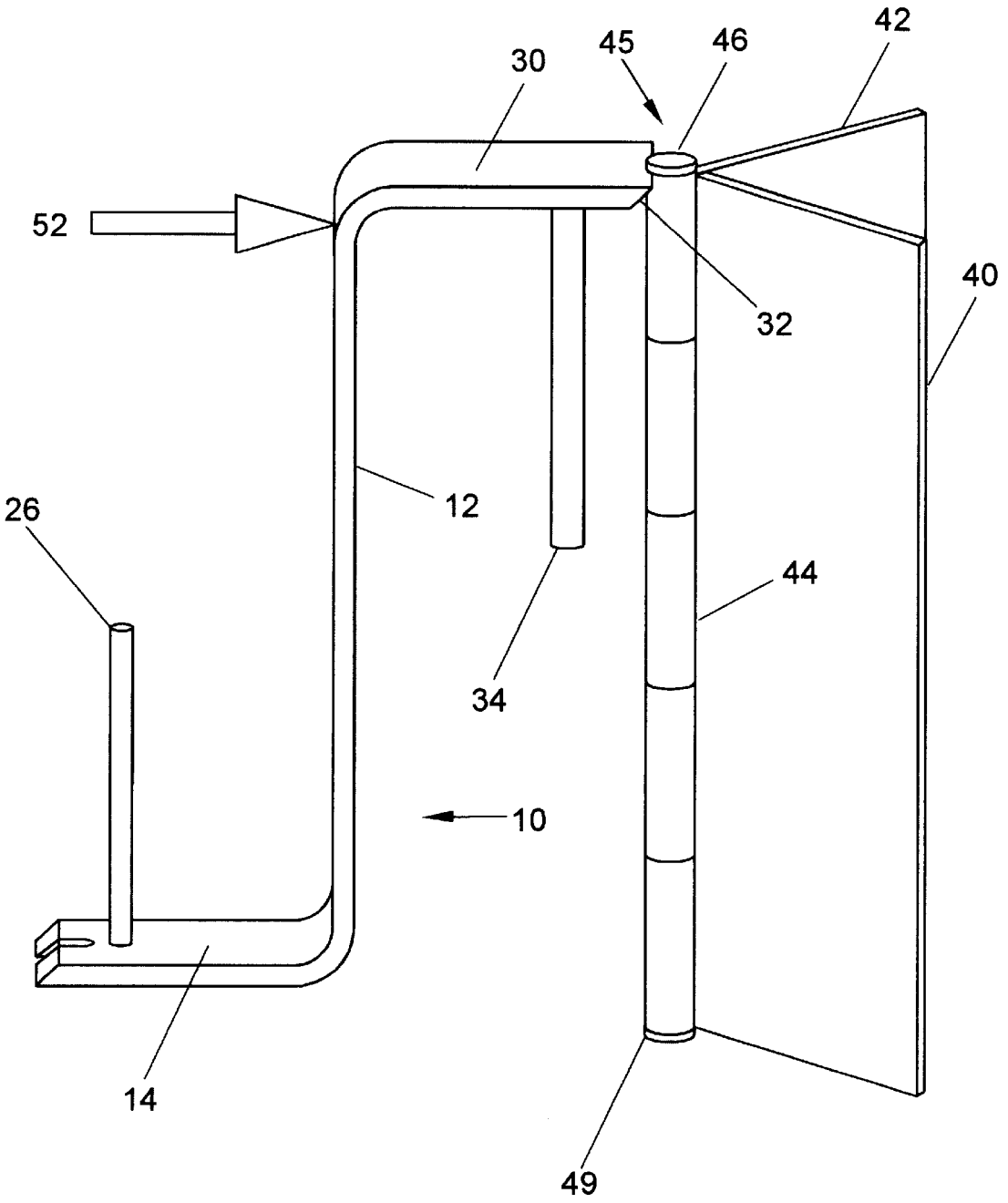
FIG. 3 is a side view showing the first version of the hinge pin removal tool as the chisel edge of the tool head is being urged between the hinge pin head and the top knuckle of the hinge.

FIG. 3 show the tapered chisel edge being urged between the pin head 46 and the top knuckle of the hinge. The tapered chisel edge is urged between the pin head 46 and the top knuckle by striking the tool head 30 at arrow 52. The sharpened beveled edge 32 will lift the pin head 46 while penetrating between the tool head and the top knuckle.

Figure 4:
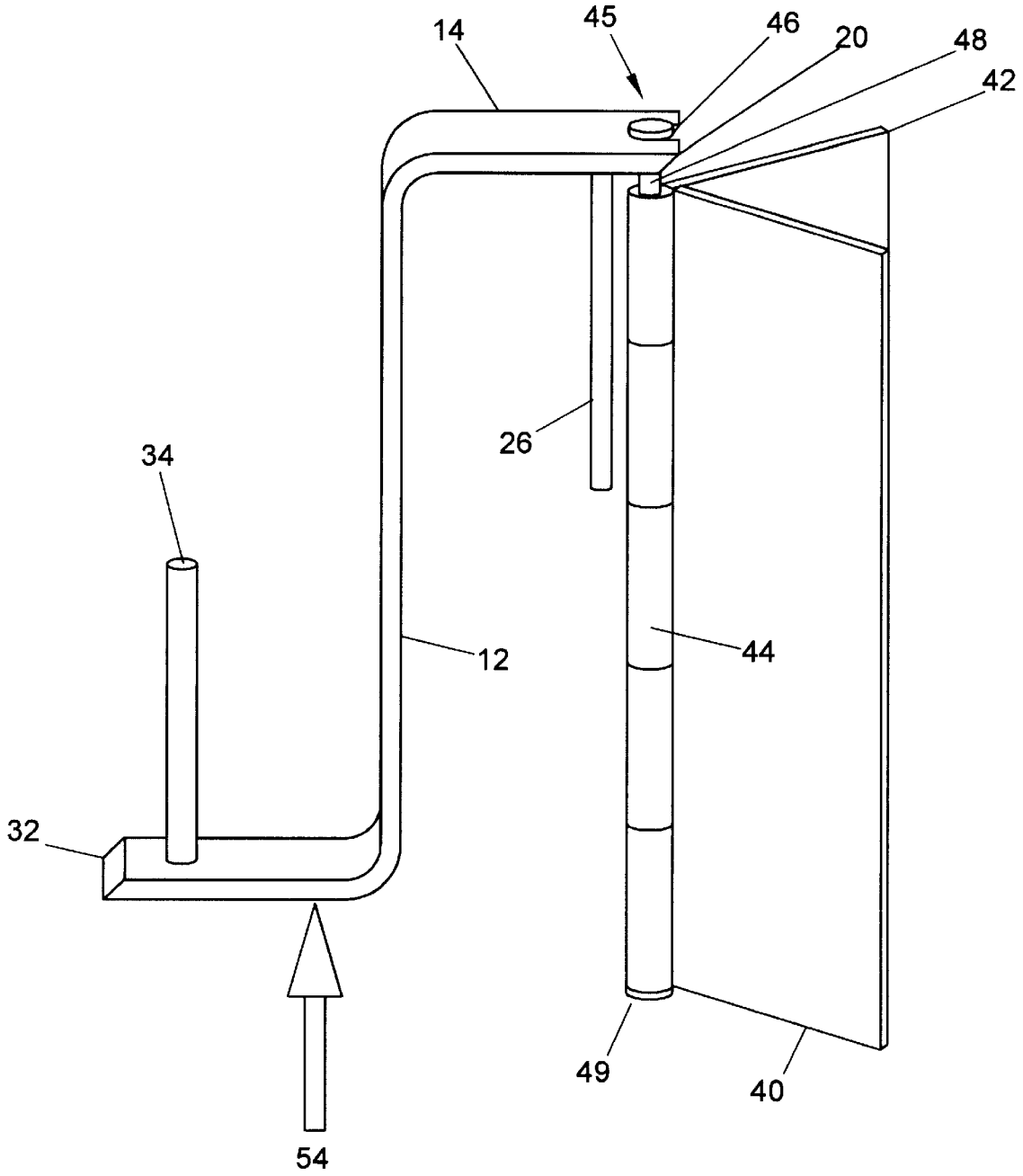
FIG. 4 is a side view showing the first version of the hinge pin removal tool as the shaft of the hinge pin is securely engaged by a slot disposed within the tool head.

FIG. 4 shows the pin head 45 lifted slightly above the hinge top knuckle to a position where the hinge pin removal tool can be turned around so that the hinge pin shaft 48 is engaged by the slot of the tool head 14. Once the tool is in this position the user can lift the tool by hand pressure to pull the hinge pin from the hinge knuckles. If the pin is difficult to remove by hand pressure, the tool may be struck as is shown at arrow 54 to drive the hinge pin 45 upward. The slot within the tool head 14 engages the hinge pin shaft securely as the tool presses on the bottom of the pin head 46. The slot prevents the tool from slipping off the hinge pin.

Figure 5:
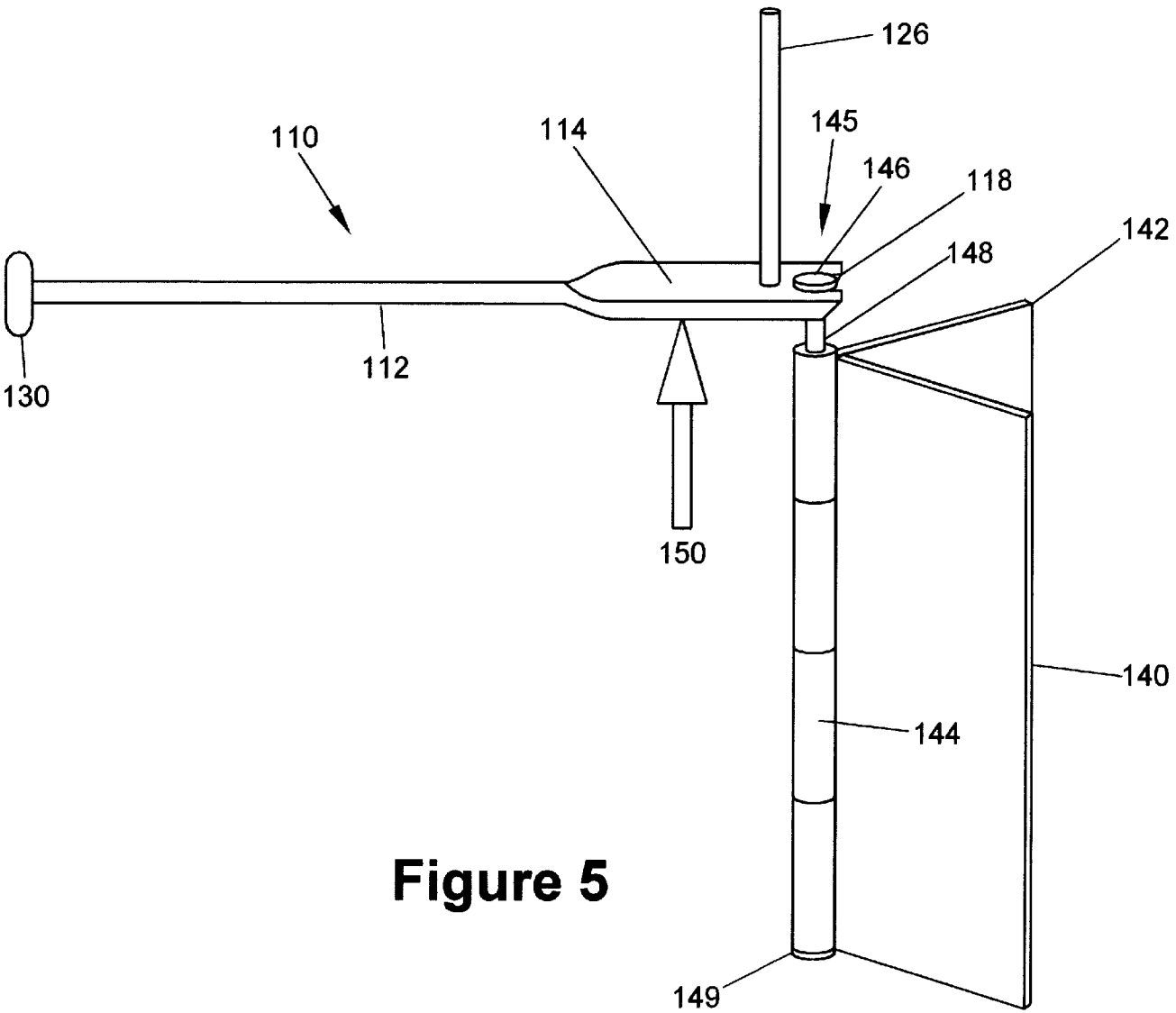
FIG. 5 is a perspective view showing a second version of the hinge pin removal tool of the present invention.

FIG. 5 shows a second version of the hinge pin removal tool 110. The tool in this version includes an elongated shaft 112, a tool head 114 disposed on one end of the shaft 112 and is substantially in line with the shaft. The tool head 114 includes a tapered chisel edge 118 including two sections separated by a slot including semicircular end wall 124. The tool head further includes a pin punch 126 disposed orthogonally to the tool head 114. Opposite the tool head, the hinge pin removal tool 110 includes a striking head 130. FIG. 5 shows the shaft 148 of hinge pin 145 engaged within the slotted end of the tool head 114. A force 150 is applied to the tool head 114 which forces the hinge pin 145 upward in relation to the hinge knuckles 144. The hinge pin removal tool is simple in use. FIGS. 2–4 show the typical steps of removing a hinge pin when using the hinge pin removal tool of the present invention. The typical first step in hinge pin removal using the hinge pin removal tool is shown in FIG. 2. In this figure the hinge bottom knuckle is accessible for using the pin punch, and although the knuckle includes a cap 49, the cap includes a passage or hole through it to allow the passage of the pin punch. The user of the tool would typically use the larger of the pin punches when possible. Many interior doors will necessitate use of the small pin punch, however.

The use of the smaller pin punch is shown in FIG. 2. The bottom of the tool head 14 provides a large striking surface which makes the upward hammer swing more likely to contact the tool head and less likely to contact the door or the door frame molding. The tool head 14 could be struck where the tool head attaches to the elongate shaft 12. This portion of the tool head would always be a safe distance from the door and door frame. The user will typically drive the pin upwardly until the head is accessible so that the hinge pin can be removed from above as shown in FIG. 4.

Should the hinge bottom knuckle be inaccessible or should the hinge bottom knuckle include a cap having no passage hole through it, the hinge pin removal tool would be used as is shown in FIG. 3. In this figure, the beveled chisel edge 32 of tool head 30 is shown being urged between the pin head 46 and the hinge top knuckle by the application of force as is shown by arrow 52. The sharp bevel edge will lift the pin head 46 from the hinge top knuckle to a sufficient height so that the tool can remove the remainder of the pin in the process again shown in FIG. 4.

FIG. 4 shows the lifting of the hinge pin 45 by engaging the shaft 48 of the pin by the slotted end of the tool head 14. It is understood that the tool could be reversed so that the majority of the tool is above the hinge pin head. In either case the user can easily lift the pin from the hinge knuckles by hand force or by the application of a striking force at 54 to drive the pin upward.

The use of the second version of the hinge pin removal tool, as is shown in FIG. 5, would be similar to the use of the first version of the tool. However, the second version is somewhat less versatile than the first version of the tool due to the single tool head and the orientation of the head in relation to the shaft. The second version of the hinge pin removal tool would be less expensive to manufacture and would subsequently be less expensive in the marketplace.

The hinge pin removal tool also would assist in the realignment of the hinge knuckles during hinge pin replacement. The pin punch could be placed in the top knuckle of the hinge section located in the door to be used to manipulate the door into the proper position where the knuckles are realigned for pin replacement. As doors provide no hand hold positions close to the hinge, the tool would be a great assistance in this process.

The chisel edge of the tool head could also be used as a wood chisel during door hanging. The chisel edge could be used to clean up the chiseled hinge plate recesses in the door or door frame molding. The chisel edge could also be used to chisel a recess in the frame molding for the door lock striker plate.

The hinge pin removal tool of the present invention would typically be manufactured from known tool steels, but could be produced from a variety of other metals, as well. The tool would provide benefits to carpenters, painters, maintenance workers, and handymen. The tool would also provide benefits to delivery men, furniture movers, carpet layers, and family members involved in household work. The tool provides these benefits at a minimal cost. The tool chisel edge would also be easily re-sharpened in a similar fashion to the sharpening of wood chisels. The pin punches also would be easily re-shaped if necessary should the tool mushroom.

It is understood that various modifications and changes of form or detail could readily be made without departing from the spirit of the invention. It is therefore intended that the invention be not limited to the exact form and detail herein shown and described, nor to anything less than the whole of the invention herein disclosed and hereinafter claimed.

I claim:

1. A hinge pin removal tool for removing a head capped pin from a knuckled door hinge, the hinge pin removal tool comprising:

an elongate shaft;

a tool head attached to the elongate shaft and extending therefrom; the tool head including a first and a second end, wherein the tool head is attached to the elongate shaft proximate to the second end of the tool head; and wherein the tool head includes a tapered chisel edge disposed at the tool head first end, and an elongate pin punch disposed orthogonally to the tool head; and, wherein the tool head further includes a striking surface opposite the pin punch.

2. The hinge pin removal tool of claim 1, wherein the tool head is disposed orthogonally to the elongate shaft.

3. The hinge pin removal tool of claim 1, wherein the tool head and elongate shaft are substantially collinear.

4. The hinge pin removal tool of claim 1, further including an open slot disposed in the chisel edge and extending inwardly therefrom toward the second end of the tool head.

5. The hinge pin removal tool of claim 4, wherein the slot includes a distal end opposed to the chisel edge, wherein the distal end includes a semicircular wall.

6. The hinge pin removal tool of claim 4, wherein the slot width is sized to accommodate a hinge pin shaft.

7. The hinge pin removal tool of claim 1, wherein the shaft includes a first and a second end and wherein the first and second end each include a tool head attached thereto.

8. The hinge pin removal tool of claim 7, wherein the two tool heads are disposed at opposite directions relative to each other.

9. The hinge pin removal tool of claim 7, wherein each said tool head includes a chisel edge and an elongate pin punch.

* * * * *